US005609127A

United States Patent [19]

Noplis

[11] Patent Number: 5,609,127

[45] Date of Patent: Mar. 11, 1997

[54] CENTRIFUGAL CONTROL ASSEMBLY FOR CAMSHAFT ADVANCE AND RETARDATION AND SUPPRESSION OF CYCLICAL VIBRATION

[76] Inventor: Edward J. Noplis, 824 Apache Trail, Lexington, Ky. 40503

[21] Appl. No.: 471,658

[22] Filed: Jun. 6, 1995

[51] Int. Cl.[6] ..... F01L 1/344

[52] U.S. Cl. ..... 123/90.17; 123/90.31; 74/568 R; 464/1

[58] Field of Search ..... 123/90.15, 90.17, 123/90.31; 74/568 R; 464/1, 160

[56] References Cited

U.S. PATENT DOCUMENTS

| | | | |
|---|---|---|---|
| 3,262,435 | 7/1966 | Cribbs | 464/1 |
| 3,455,286 | 7/1969 | Reisacher et al. | 464/1 |
| 4,955,330 | 9/1990 | Fabi et al. | 123/90.17 |
| 5,181,486 | 1/1993 | Gyurovits | 123/90.17 |

*Primary Examiner*—Weilun Lo
*Attorney, Agent, or Firm*—Laurence R. Letson

[57] ABSTRACT

A centrifugally actuated control is disclosed for shifting the camshaft of an internal combustion engine between an advanced and retarded condition relative to the ring sprocket and timing chain which are driven by the crankshaft of the internal combustion engine. The control device advantageously causes the shifting from an advanced condition to a retarded condition at a predetermined engine speed or RPM and causes the conditions of engine operation to improve for higher engine speed operation as well as maintains low engine speed operation at high efficiency levels. As the engine is slowed, the device restores the camshaft to its advanced condition for more efficient operation at the lower engine speed. The breakover point or engine speed at which the transition between advanced and retarded positioning occurs may be determined by the strength of the springs contained within the control assembly together with the mass of the centrifugally actuated arms contained therein.

13 Claims, 2 Drawing Sheets

CENTRIFUGAL CONTROL ASSEMBLY FOR CAMSHAFT ADVANCE AND RETARDATION AND SUPPRESSION OF CYCLICAL VIBRATION

FIELD OF THE INVENTION

This invention relates to camshaft timing in internal combustion engines and more specifically to the advancement and/or retardation of camshaft timing in order to gain improved performance over extended portions of the engine speed spectrum.

BACKGROUND OF THE INVENTION

Those internal combustion engines which have valves to control the entry of combustible gases and the escape of exhaust gases have a camshaft to precisely control the timing of the opening and the closing of both the intake and exhaust valves in a precise relationship to the position of the piston within the cylinder.

Conventional camshaft positioning and, hence, the opening and closing times of the valves are determined by adjustment of the cam sprocket to a position relative to a timing mark, which is determined relative to the piston location as dictated by the rotational position of the crankshaft of the engine. Once in the desired advanced/retarded position or dead center, the sprocket and camshaft each rigidly attached to the other thus are driven by the crankshaft and timing chain in a timed relationship. At optimum for one set of operating conditions of the engine, the timing of the camshaft is a compromise over the full spectrum of the engine speed (RPM's).

Internal combustion engines, such as automobile and truck engines, operate at widely varied engine speeds. Whenever operating at other than the optimum engine speed for which the camshaft is timed, the camshaft timing is less than optimum and in some cases will significantly degrade the engine performance from that obtainable by adjustments of the cam timing for that specific engine speed. If cam timing is adjusted to a different operating point (engine speed), then the newly selected operating point becomes the optimum operating point, and the operating performance of all other operating engine speeds are compromised to some extent.

The retarding of the cam allows the pressures in the cylinders to be reduced at the end of the exhaust stroke to a level approaching atmospheric pressure enhancing the entry of the fuel/air mixture, thereby improving performance.

In regard to any engines, the composition or mix and quantities of emissions varies with the operating speeds of the engine. Thus, an engine with the camshaft advanced to produce low engine speed torque improvement will produce excessive emissions at higher engine speeds because the valve timing should be retarded at higher speeds to optimize burning of the fuel/air mixture and to produce minimum exhaust emissions. For engines with the valve operations timed for optimum operations at higher engine speeds, the engine will not produce optimum performance and consequently will produce excess emissions whenever operating at lower operating speeds.

Previous attempts have been made to provide a solution to the camshaft timing dilemma described above, but none are known that have been completely successful.

U.S. Pat. No. 3,516,394 issued to R. G. Nichols disclosed a speed responsive device for controlling a two-part camshaft, using sliding centrifugal weights.

U.S. Pat. No. 4,177,773 issued to John R. Cribbs discloses a damped variable valve timing arrangement using springs to dampen vibration and extend life.

U.S. Pat. No. 4,615,313 issued to Yoshinori Tsumiyama discloses a centrifugally controlled decompression device to decompress the engine cylinders at low engine RPM.

U.S. Pat. No. 4,955,330 to Christian Fabi et al. discloses a cam timing device using sliding centrifugal weights to effect the camshaft advance and retardation. The weights are spring biased to a low speed, camshaft advanced position.

U.S. Pat. No. 5,056,478 to Thomas T. Ma discloses a hydraulic control for effecting camshaft timing.

U.S. Pat. No. 5,181,486 to John S. Gyurovits discloses a centrifugally actuated cam timing device which uses sliding weights to effect cam timing by interfacing the weights to phasing ramps.

U.S. Pat. No. 5,228,417 to Seinosuke Hara discloses a hydraulic valve timing adjustment control.

All of the above patents fail to provide a viable solution to the problem of controlling valve timing advance and retardation in response to engine speed, because the systems are either too complex and expensive or the devices do not provide positive drive connection between the element providing the drive force and sprocket to insure stable force transmission unaffected by vibrations overcoming the drive connection.

Internal combustion engines have been determined to provide a very wide range of loading on the timing chain driving the camshaft due to cyclical vibrations. Cyclical vibration is caused by those cyclical forces exerted on the lobe of the camshaft by the valve springs as well as the forces exerted on the camshaft through the timing chain and camshaft timing sprocket.

The forces of the valve springs are exerted at different locations on the cam profiles and in differing magnitudes due to the amount of cam rise at the point of lifter (follower) engagement with the cam. Further, while spread out substantially uniformly over time, the firing or ignition of the combustible mixture in the cylinders creates power or force peaks on the crankshaft and results in the cyclic vibration being transmitted through the timing chain and the timing chain sprocket on the camshaft and to the camshaft itself. The additive effect of the cyclical forces from the lifters and the cyclical forces from the timing chain is that the timing chain loading of the camshaft sprocket varies from positive loads to negative loads, particularly at a steady engine speed (constant engine RPM).

The constantly changing chain loading, particularly the negative loading, on the sprocket and/or the camshaft results in such destructive cyclical vibration that the timing chain may be damaged or destroyed by running the engine at constant RPM for an extended period of time. As is well known, whenever a timing chain breaks and the camshaft no longer is rotationally synchronized with the rotation of the crankshaft, the engine may experience significant damage or may be destroyed.

While complete elimination of the cyclic vibration which is so destructive to the timing of the camshaft may not be accomplished by any means because of the intermittent loading of camshaft and the crankshaft, the cyclic vibrational effects may be greatly mitigated by eliminating negative loading on the timing chain. If the negative timing chain loads are eliminated, then the chattering and jumping of the mechanical parts flowing from the intermittent negative loading also may be eliminated.

OBJECTS OF THE INVENTION

It is an object of the invention to automatically adjust the camshaft of an internal combustion engine from an advanced condition to a retarded condition as the engine speed increases.

It is another object of the invention to re-time the camshaft on an internal combustion engine for a predetermined engine operating speed; and as the engine operating speed approaches the predetermined engine operating speed, whereby the engine performance may be reoptimized for more than one engine operating speed.

It is a further object of the invention to adjust the camshaft timing to provide reduced exhaust emissions for the engine in more than one region of the operating speed spectrum.

It is a still further object of the invention to improve the reliability of the timing train components and to improve engine life.

SUMMARY OF THE INVENTION

In order to overcome the shortcomings of the prior art and to accomplish the objects of the invention, an engine speed responsive drive coupling is introduced between the timing sprocket and the camshaft. The camshaft and the drive coupling are further provided with and enhanced by a flywheel which absorbs and dampens the cyclic vibrations found in the system.

A camshaft is attached to a hub in a conventional manner with mounting bolts. The hub supports a plurality of centrifugally responsive levers that tend to pivot with rotational movement of the hub. The levers are provided with dogs or arms which fit into and are engaged with the inner rim of a ring sprocket. The ring sprocket is engaged with and driven by a conventional timing chain and, in turn, drives the sprocket and the hub to rotate the camshaft.

Springs are arranged to bias the levers inward by forcing the ring sprocket to a position that pivots the levers inwardly. The spring force is sufficient to overcome the centrifugal movement of the levers at lower engine speeds. As engine speed and camshaft rotational speed increase, the centrifugal force of the mass of the levers exceeds and overcomes the spring forces while the camshaft rotationally shifts relative to the ring sprocket, thereby retarding the timing of the camshaft controlled operation of the exhaust and intake valves of the engine relative to the crankshaft of the engine or the piston position within the cylinder.

This speed responsive coupling operates to maintain the camshaft in an advanced timing condition during low engine speed operation which results in the best torque output for low end operation; and as the centrifugal force of the levers grows with increased engine speed and eventually exceeds the forces of the springs that act to advance the camshaft timing, the camshaft timing is retarded by the movement of the levers. The coupling between the timing chain and the camshaft is further provided with a flywheel to substantially increase the mass of the camshaft/sprocket/hub. The benefit of the flywheel is that the cyclic vibrations of and/or transmitted to the camshaft are significantly reduced and damped and negative loading of the timing chain is significantly reduced, if not eliminated.

A better and more complete understanding of the invention may be had from the attached drawings and the detailed description of the invention that follows.

A DETAILED DESCRIPTION OF THE PREFERRED EMBODIMENT OF THE BEST MODE CONTEMPLATED BY THE INVENTOR FOR CARRYING OUT THE INVENTION

Figure 1:
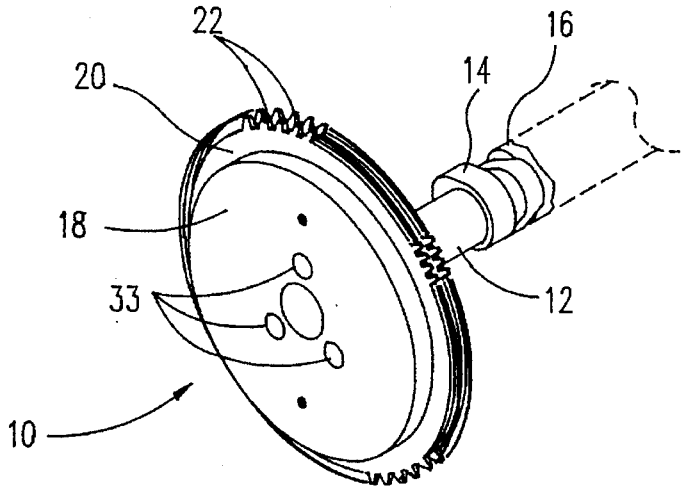
FIG. 1 is a perspective view of the invention mounted on a camshaft segment.

Referring initially to the drawing in FIG. 1, the invention, a centrifugally actuated camshaft advance/retard control 10, is shown attached to a camshaft 12 which has cam lobes 14 and 16 disposed on shaft 13. Typically, camshaft 12 is considerably longer and will contain a larger number of lobes than illustrated but its length and cam lobe count are dependent upon the design of the engine. For example, if the camshaft 12 is serving all of cylinders of a V-8 engine and each cylinder has a single intake and a single exhaust valve, there would be sixteen such lobes 14, 16 on the camshaft 12. By further way of example, for a six cylinder engine with all six cylinders in-line and where each cylinder has a total of four valves, two intake and two exhaust, then the camshaft 12 would have a total of 24 cam lobes similar to the cam lobes 14 and 16, as illustrated in FIG. 1.

The device of the present invention as illustrated in FIG. 1 includes a flywheel 18 and a timing chain sprocket 20. The timing chain or ring sprocket 20 has a double set of sprocket teeth 22. Only a portion of the total number of sprocket teeth 22 are illustrated herewith but extend completely around the sprocket 20.

Figure 2:
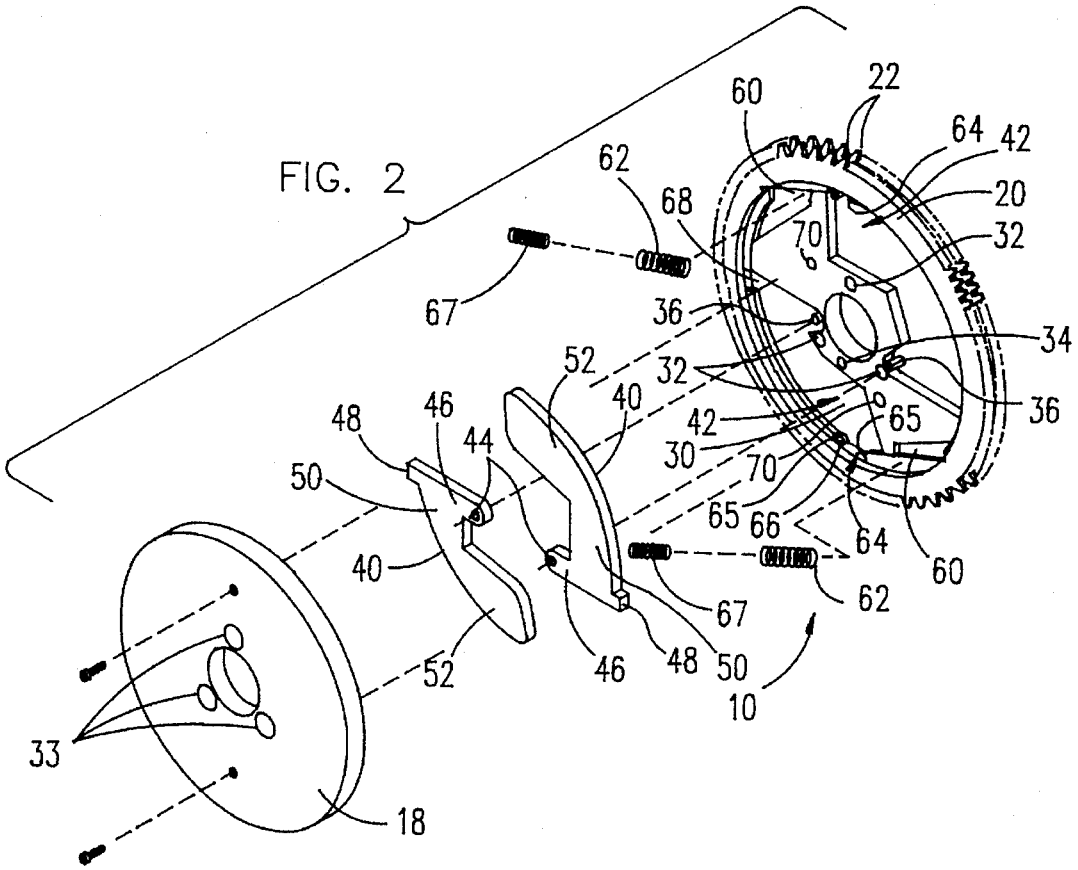
FIG. 2 is an exploded perspective view of the invention.

Referring now to FIG. 2, an exploded view of the centrifugal control assembly 10 for camshaft 12 advance and retardation is illustrated. Flywheel 18 has been removed and moved leftward to permit a view of the interior of the remainder of the centrifugal control assembly 10. Control assembly 10 has a hub 30 which is attached by bolts (not shown) that extend through bolt holes 33 in fly wheel 18 and 32 to the camshaft 12 (not shown in FIG. 2). Dowel hole 34 is precisely located with respect to the remainder of the surfaces on hub 30 so that a dowel pin, not shown, on the end of the camshaft 12 may be inserted from the back side to precisely position the camshaft 12 with respect to the hub 30. Pivot posts 36 are similarly precisely located relative to hub 30. Centrifugal actuator levers 40 are positionable within the recesses 42 formed in hub 30.

Hub 30 may be manufactured by machining a piece of bar or plate stock, preferably of steel for strength, and removing those areas such as recesses 42 to provide a volumetric space into which actuator lever arms 46 may be disposed with the holes 44 of levers 40 disposed over pivot posts 36 on hub 30.

Lever 40 is provided with a lever arm 46 extending to a lever arm extension or dog 48 which extends generally radially from pivot hole 44. Extending from one side of the lever arm 46 is an arm 50 which, in turn, supports the centrifugally affected mass 52, otherwise referred to as a centrifugal weight 52.

Ring sprocket 20 surrounds hub 30 and possesses interior surfaces which are positionally disposed relative to hub 30. Ring sprocket 20 in cooperation with hub 30 forms cavities 60 which, in turn, accommodate compression springs 62. Additionally, ring sprocket 20 has a portion of an inner ring 31 or flange 31 removed in the region 64 at two places diametrically across the ring sprocket 20 to accommodate stop lugs 66 (only one shown). A further gap 68 is formed into the interior ring/flange 31 surface of the sprocket 20 to accommodate dogs 48 on levers 40. Inner ring/flange 31 overlies the periphery of hub 30 as is observable in FIG. 3 and provides the material to form or define the gaps 64 and 68 therein. Inner ring/flange 31 is a part of and extends inwardly from ring sprocket 20.

Figure 3:
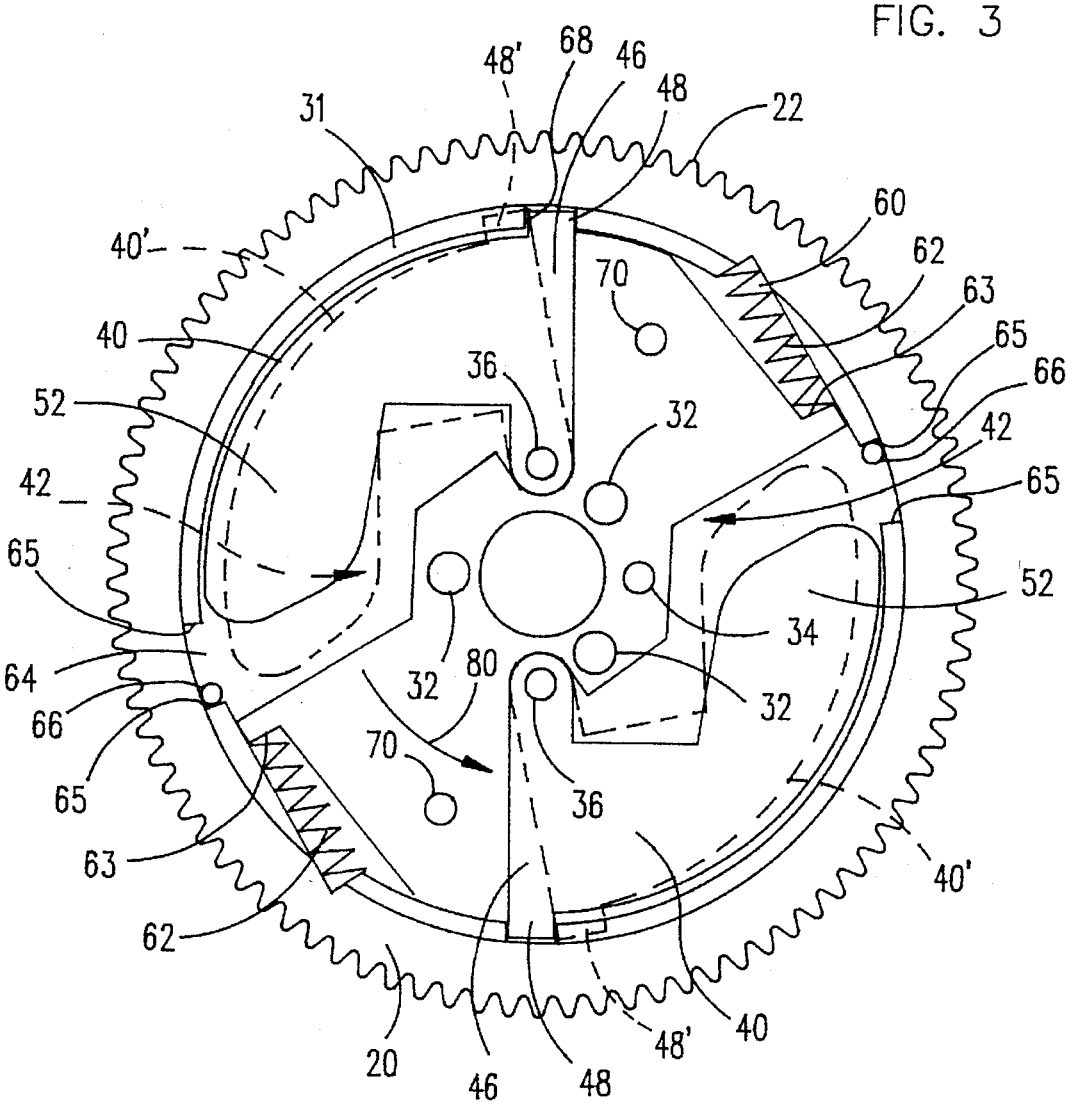
FIG. 3 is a plan view of the invention with the flywheel removed.

The operation of the device may be best understood by referring to FIG. 3 which illustrates the device with the flywheel 18 removed.

The sprocket 20 is engaged with and driven by a conventional timing chain as is well known; therefore, the chain is not illustrated for simplicity. The drive of sprocket 20 could be a gear drive if desired. Sprocket teeth 22 cause the engagement to be such that the chain will not slip with respect to sprocket 20 and will drive sprocket 20 in a clockwise direction. In turning, sprocket 20 will create a force against compression springs 62 disposed within reliefs 60. The forces exerted on the end of compression springs 62 will be transferred through the coils of spring 62 onto the spring engaging surface 63 of hub 30. As sprocket 20 is rotated in a clockwise direction by the timing chain (not shown) and the force exerted on the sprocket 20 by the timing chain is transferred through compression spring 62 to hub 30, hub 30 will rotate clockwise in synchronized rotation with the sprocket 20. Since the drive of the hub 30 is through springs 62, hub 30 is rotated under the spring force clockwise with respect to the sprocket 20.

In the condition where the drive of the hub 30 is exclusively through spring 62, the centrifugal actuator levers 40' are disposed in the positions illustrated by the dashed lines and indicated as 40'. Dogs 48' are engaged in gaps 68 of ring sprocket and are maintained in the 48' position by the relative rotation of the hub 30 being advanced relative to the rotational position of the sprocket 20 by the reactive force of compression springs 62. Inasmuch as camshaft 12 illustrated in FIG. 1 is attached by bolts (not shown) through bolt holes 32 in hub 30 and has a dowel pin extending into dowel pin hole 34 for alignment purposes, whenever the hub 30 is in an advanced state or position relative to the ring sprocket 20, then the camshaft 12 is similarly advanced by a like angular amount relative to the sprocket 20 and timing chain driving the sprocket 20. The timing chain is driven by a similar sprocket on the crankshaft of the internal combustion engine (not shown) and thus the hub 30 and the camshaft 12 are both in an advanced state relative to the crankshaft of the internal combustion engine. During low engine speed operation, springs 62 are sufficiently strong to overcome any forces exerted on the camshaft 12 and the hub 30 and, therefore, keep the hub 30 and camshaft 12 in an advanced condition.

The sprocket 20, hub 30 and camshaft 12 rotate at speeds commensurate with the operational engine speed of the internal combustion engine. As the engine speed or RPM of the engine increases, the centrifugal force created by rotation will attempt to cause pivoting of the levers 40 about pivot posts 36 in a clockwise direction around pivot posts 36. The levers translation from the 40' positions to the 40 positions causes a commensurate clockwise displacement of the dogs 48 about pivot posts 36 and a generally clockwise displacement of ring sprocket 20 with respect to the hub 30. As one will appreciate, any movement of levers 40 from the dashed line depiction 40' to the solid line depiction of levers 40 will cause a retardation of the hub 30 and camshaft 12 relative to sprocket 20.

Typical limits of advancement and retardation of the camshaft 12 with respect to sprocket 20 would be four degrees in either direction from dead center, but the advancement/retardation could be increased up to as much as 15°–20° either side of dead center if the engine design would permit and operating conditions required. By properly selecting the dimensions of the levers 40 and the amount of movement of the sprocket 20 relative to the stop lugs 66 within the gaps 64, a total of eight degrees of movement of the hub 30 relative to sprocket 20 may be defined. Thus, the movement of centrifugally actuated levers 40 from the position designated 40' to the position designated 40 represents eight degrees of relative movement between the hub 30 and sprocket 20 and therefore between the camshaft 12 and sprocket 20.

Whenever all of the drive forces are transmitted through the springs 62 and the camshaft 12 and hub 30 are advanced four degrees, the camshaft 12 will be in its fully advanced position. With an increase in engine speed past the point where sufficient centrifugal force exerted by rotating the mass 52 of levers 40 to cause the levers 40 to occupy the solid line positions 40 overcomes the resistance of springs 62, the hub 30 will be retarded by eight degrees from the advanced position to the retarded position moved relative to the sprocket 28 in the direction of arrow 80.

This retarded condition is most desirable for high speed or high RPM operation of the internal combustion engine and is the result in movement of levers 40 to an outwardly displaced position by centrifugal force.

When the forces of the sprocket 20 being driven in the clockwise direction are transmitted through the springs 62 to the hub, springs 62 will maintain the hub in an advanced condition relative to the sprocket 20. The dog 48 of the lever 40 is disposed in the 48' position by the rotation of the hub 30 and the lever pivot 36 in a clockwise direction relative to the sprocket 20 under the influence of the springs 62. This clockwise displacement of hub 30 relative to the sprocket positions the hub 30 in an advanced relationship to the sprocket 20. As the speed of the engine increases, the centrifugal forces acting on the levers 40 pivot the levers 40 clockwise about their respective pivots 36. This pivoting motion, because the dog 48 is confined by the sprocket 20, causes the pivots 36 to move counterclockwise relative to the sprocket, retarding the hub 30 and the cams attached thereto relative to sprocket 20. The movement of the hub 30 relative to the sprocket 20 under the influence of the levers 40 moving from the dashed line position to the solid line position is in the direction of arrow 80 and retarding the hub 30 and the attached camshaft 12.

The width of gaps 64 in ring sprocket 20 may be tailored to limit the amount of advance and retardation of the hub 30 and camshaft 12 relative to sprocket 20 since the blocking ends 65 forming gaps 64 can engage the stops 66. The engagement of the blocking end 65 of gap 64 with the stop 66 in a retarded position creates a solid driving condition.

Holes 70 are useful to attach the flywheel 18 to the hub 30 for rotation with the hub 30. The additional mass provided by the flywheel 18 tends to absorb, smooth, and dampen the cyclical vibrations created by the discontinuous loading of the camshaft 12 and the firing of the combustible mixture in the cylinders of the internal combustion engine. The inertia of the flywheel 18 may be selected to be sufficiently large to substantially eliminate the negative timing chain loading which has heretofore been so detrimental. By pivoting levers 40 on the hub 30, the mass 52 may be concentrated in the hub 30 rather than in the ring sprocket 20, further improving the cyclic vibration dampening.

With the foregoing understanding of the construction and the operation of the centrifugally actuated cam advance and retardation control 10, it can be seen that the advantageous condition of advancing the camshaft relative to the crankshaft position during low-end engine speeds may be attained while at the same time provides for a shifting or a retarding of the camshaft relative to the crankshaft at a higher or breakover engine speed. The breakover speed for a particular device may be readily defined by the selection of the mass to spring-force-ratio where the mass 52 of the lever 40 and its center of gravity is selected to provide a predetermined amount of force through dog 48 at a selected engine speed.

The spring constant and configuration of springs 62 are similarly selected to overcome the effect of the mass 52 at the various speeds of operation up to a desired breakover speed wherein the centrifugal force of the rotating mass 52 of levers 40 will exceed the spring force. The breakover point or speed may be defined as a particular RPM or engine speed. The breakover will be somewhat gradual over a relatively narrow band of engine speeds and will not be an abrupt shift.

If an engine is anticipated to be operated at a fixed or steady engine speed, that speed should be above the breakover speed so that the camshaft is fully retarded. When the centrifugal force and the spring forces are balanced, the state of the camshaft (retarded or advanced) is not well defined and may not yield the desired efficiencies.

Due to the need for substantial spring force in springs 62, a possibility exists where the wire diameter and the coil pitch are such that whenever spring 62 is compressed to resist the centrifugal force by the relative movement of the ring sprocket 20 and hub 30, the coils of the springs 62 may be compressed into engagement with each other; thus, the spring 62 becomes a solid column. In that condition, the spring 62 ceases to be able to yieldingly respond to the forces exerted thereon and the retarding of the camshaft to its maximum may be prevented by the solid column. Due to the fact that the spring 62 can no longer provide spring qualities whenever it becomes a solid column, additional spring force may be required to attain the breakover speed desired without compressing the springs 62 to a solid column.

A solution to this problem may be the insertion of a smaller diameter spring 67 inside the larger diameter spring 62 such that the second spring 67 provides supplemental spring force simultaneously with the first spring 62 together with reducing the physical dimensions of the spring to prevent the column effect. The second or supplemental spring 67 is illustrated in FIG. 2. The selection of the spring 62 parameters may be such that the breakover point is attained in addition to being able to design the spring 62 so the spring cannot be compressed to a solid column condition.

It will be further appreciated that this control 10 whenever running with the camshaft 12 in a retarded condition at or above the breakover point will result in reduced exhaust emissions because the opening of the exhaust valves will be delayed by four degrees relative to the crankshaft position. The delay in the opening of the exhaust valves permits a more complete in cylinder burning of the combustible gases prior to their release to the exhaust system. This may prove to be an advantage in the control of pollution completely apart from and in addition to the benefits of maximizing and optimizing the torque output at both low end engine speeds and high end engine speeds.

This device further provides a control over the ignition timing since the distributor or the electronic ignition timing control is typically driven by the camshaft. The distributor has in the past incorporated an ignition advance and retard control. The instant device will adjust the ignition timing to a limited amount by deriving the ignition timing base point from the cam and its timing relative to the crankshaft (not shown).

It should be understood that minor changes and modifications to the design of this device can be made and may further enhance the device without removing the resulting device from the scope of the attached claims which set forth and define the invention.

I claim:

1. A controllable camshaft assembly for use in an internal combustion engine, comprising:

a camshaft including a shaft, a gear mounting portion, and a plurality of cam lobes disposed with the rises and dwells of said lobes in a predetermined rotational relationship to said shaft, a timing gear assembly fixedly attached to said camshaft gear mounting portion of said camshaft for rotation with said camshaft;

said timing gear assembly comprising a hub;

a ring sprocket, said ring sprocket further comprising a plurality of abutment surfaces incorporated into an interior portion of said ring sprocket;

a fly wheel and a plurality of centrifugally responsive levers;

a plurality of springs;

said centrifugally responsive levers pivotally mounted on said hub for rotation therewith;

said centrifugally responsive levers biased by said springs against centrifugal forces to a retracted position whenever rotating with said hub and said camshaft at speeds where centrifugal forces on said levers are less than forces exerted by said springs;

said centrifugally responsive levers each comprised of an arm extending outwardly from said lever and engaging said ring gear at one of said abutment surfaces.

2. The controllable camshaft assembly of claim 1 wherein said hub comprises abutment surfaces disposed thereon, opposing and spaced from a third abutment surface on said ring sprocket; and a first spring disposed between said third abutment surface and one of said abutment surface on said hub.

3. The controllable camshaft assembly of claim 2 wherein said first spring is a compression spring.

4. The controllable camshaft assembly of claim 3 wherein said first spring circumscribes within its coils a second compression spring disposed coaxially with said first spring.

5. The controllable camshaft assembly of claim 1 wherein said hub comprises at least one stop member extending from said hub in a direction parallel to an axis of rotation of said hub, said stop member disposed to be engaged by an abutment surface on said ring sprocket.

6. The controllable camshaft assembly of claim 5 wherein said flywheel is disposed coaxially to said hub and said ring gear and fixedly attached to said hub and said camshaft.

7. A timing sprocket assembly for attachment to a camshaft of an internal combustion engine having a crankshaft, for receiving drive forces from a timing chain and transmitting driving forces from said timing chain to said camshaft comprising:

a hub attachable to and rotatable with said camshaft;

a pair of centrifugally displaceable pivotal levers supported for pivoting movement relative to said hub;

a ring sprocket circumscribing said hub and said levers;

said levers engaged with said ring sprocket and effective to displace said ring gear rotationally relative to said hub under rotationally induced centrifugal displacement of said levers; and a flywheel coupled to and rotatable with said camshaft, whereby said levers displace said ring sprocket to a position relative to said camshaft such that said camshaft is retarded with respect to said crankshaft.

8. The timing sprocket assembly of claim 7 further comprising spring biasing said hub relative to said ring sprocket, whereby said hub and said camshaft assume an advanced position at operating speeds of less than a speed at which the centrifugal force of said levers exceeds combined forces of said springs biasing said ring gear relative to said hub.

9. The timing sprocket assembly of claim 8 wherein said levers engage and act upon said abutment surfaces of said ring gear.

10. The timing sprocket assembly of claim 9 wherein said spring bias is derived from a compression spring compressed between an abutment surface on said hub and on abutment surface on said ring gear.

11. The timing sprocket assembly of claim 10 wherein said hub further comprises a plurality of limit stops engagable with said ring sprocket, thereby limiting relative rotational movement of said ring gear and said hub to a predetermined range of movement.

12. The timing sprocket assembly of claim 10 further comprising a flywheel mass coupled to said camshaft.

13. A method of advancing a valve control camshaft relative to a timing sprocket in an internal combustion engine during low range engine speeds and retarding said valve control camshaft in an internal combustion engine during high range engine speeds, comprising the steps of:

driving said camshaft timing sprocket in synchronism with said camshaft;

rotationally displacing said camshaft with respect to said timing sprocket responsive to increased engine speed;

wherein said step of displacing includes the step of rotating a centrifugally responsive lever about an axis of rotation of said camshaft;

increasing said rotation of said lever to a rotational speed sufficient to overcome any resilient resistance to movement of said timing sprocket with respect to said camshaft;

responsive to centrifugal displacement of said lever, rotationally translating said timing sprocket relative to camshaft in a direction identical to said rotation of said timing sprocket, coupling said timing sprocket to said camshaft in a solid drive connection;

whereby said camshaft is advanced relative to said crankshaft position at low speeds and retarded at higher engine speeds, thereby providing a relative camshaft position most productive of engine torque at both low engine speeds and higher engine speeds.

* * * * *